US008376137B2

(12) United States Patent
Laurienzo et al.

(10) Patent No.: US 8,376,137 B2
(45) Date of Patent: Feb. 19, 2013

(54) TRY ME PACKAGING FOR AN ULTRAVIOLET REVEAL FEATURE

(75) Inventors: Dominic Laurienzo, Los Angeles, CA (US); Rip Lopusnak, Canoga Park, CA (US); Brandon Giraldez, Marina Del Ray, CA (US); Dennis Lee Chi Wai, Hong Kong (CN); Paul Isia, West Hollywood, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 0 days.

(21) Appl. No.: 13/101,930

(22) Filed: May 5, 2011

(65) Prior Publication Data

US 2012/0279880 A1 Nov. 8, 2012

(51) Int. Cl.
*A63H 33/22* (2006.01)
*A63H 3/12* (2006.01)
*B65D 77/26* (2006.01)

(52) U.S. Cl. ..... 206/457; 206/776; 446/75; 446/219

(58) Field of Classification Search ..... 206/457, 206/777, 776; 446/175, 219, 75, 485, 77
See application file for complete search history.

(56) References Cited

U.S. PATENT DOCUMENTS

| | | | | | |
|---|---|---|---|---|---|
| 2,162,998 | A * | 6/1939 | Fisher | 40/540 |
| 2,310,037 | A * | 2/1943 | Reno | 446/379 |
| 3,392,823 | A * | 7/1968 | Green et al. | 206/777 |
| 3,553,885 | A * | 1/1971 | Kazuo | 446/279 |
| 4,257,188 | A | 3/1981 | Barker | |
| 5,172,937 | A * | 12/1992 | Sachetti | 283/81 |
| 5,176,905 | A | 1/1993 | Ohno et al. | |
| 5,208,132 | A * | 5/1993 | Kamada et al. | 430/138 |
| 5,730,638 | A * | 3/1998 | Ward | 446/297 |
| 5,980,352 | A * | 11/1999 | Rigberg | 446/73 |
| 6,322,416 | B1 | 11/2001 | Burke | |
| 7,249,431 | B1 | 7/2007 | Rose et al. | |
| D609,560 | S * | 2/2010 | Mchatet | D9/415 |
| 7,766,717 | B2 * | 8/2010 | Shapiro | 446/236 |
| 2002/0162771 | A1 * | 11/2002 | Van Wagenen et al. | 206/775 |
| 2004/0135097 | A1 | 7/2004 | Shibahashi et al. | |
| 2006/0078673 | A1 * | 4/2006 | Ripstein | 427/157 |
| 2007/0128972 | A1 | 6/2007 | Schmidt et al. | |
| 2008/0308085 | A1 * | 12/2008 | Polk, III | 124/1 |
| 2011/0088292 | A1 * | 4/2011 | Kay et al. | 40/124.02 |

* cited by examiner

*Primary Examiner* — J. Gregory Pickett
*Assistant Examiner* — Mollie Llewellyn
(74) *Attorney, Agent, or Firm* — Tope-McKay & Associates

(57) ABSTRACT

A packaging item for packaging a toy and an ultraviolet light accessory is described. The packaging item includes a transparent packaging shell and a toy positioning packaging. The transparent packaging shell has an opening therethrough to allow for access by a user. The toy positioning packaging is positioned within the transparent packaging shell. The toy positioning packaging includes a toy packing portion and an ultraviolet light accessory portion. The toy packing portion is formed to hold both the toy and ultraviolet light accessory such that upon activation, ultraviolet light is directed from the ultraviolet light accessory onto a portion of a toy that includes a reveal pigment. Upon exposure to the reveal pigment, the reveal pigment becomes visible to reveal a unique feature of the toy. The toy is, for example, a figurine.

5 Claims, 9 Drawing Sheets

TRY ME PACKAGING FOR AN ULTRAVIOLET REVEAL FEATURE

BACKGROUND OF THE INVENTION (1) Field of Invention

The present invention relates to product packaging and, more particularly, to product packaging that includes a toy and an ultraviolet light accessory positioned within the packaging to illuminate the toy.

(2) Description of Related Art

Toys with exposable features have long been known in the art. For example, toys have been devised to change colors when exposed to certain elements.

By way of example, some toy dolls have been devised that include skins or exterior surfaces that change color in response to water exposure. U.S. Pat. No. 4,257,188 (the '188 patent) discloses toy dolls and figurines having surface portions of reversibly changeable color. The '188 patent teaches a doll with an color changing layer positioned on its exterior that will reversibly change color after exposure to water. Such a feature provides a play pattern of allowing a child to simulate a diaper rash on a doll by "wetting" a diaper. Other play patterns can be envisioned, where, for example, the color changing layer is applied to a baby doll bottle. Thus, by filling the bottle with water, the bottle will change colors. After removing the doll and color changing layer from the water exposure, the color changing layers slowly reverts back to its original color.

Other toys have been devised that change color in response to light exposure. For example, U.S. Pat. No. 6,322,416 (the '416 patent) discloses a photochromatic toy that changes color as a result of exposure to ultraviolet light. More specifically, the '416 patent describes toy soda bottles that have a photochromatic coating that, when exposed to the ultraviolet light, causes the bottles to change color and appear as if they are full of soda. Upon removing the toy soda bottles from the ultraviolet light exposure, the color in the photochromatic coating slowly reverts back to its original color.

As described above and as used in the prior art, the color changing elements (e.g., color changing layer and/or photochromatic coating) slowly change color in response to the applicable exposure element (e.g., water or ultraviolet light). Alternatively, after removal of the applicable exposure element, the color changing element slowly reverts to its original color. In both cases, the color change from the first to the second color, and reversal from the second color to the first color, is not instantaneous.

Thus, a continuing need exists for a toy having exposable features that are immediately revealed when exposed to ultraviolet light and that are immediately concealed upon removal of the ultraviolet light. Further, a need exists for product packaging having such a toy therein with an ultraviolet light accessory positioned within the packaging to illuminate the toy and reveal the exposable feature.

SUMMARY OF INVENTION

While considering the failure of others to make use of all of the above components in this technology space, the inventors unexpectedly realized that a unique try me packaging item that positions both a toy and ultraviolet light accessory would allow a potential consumer to view the unique features of the toy therein.

The packaging item includes a transparent packaging shell and a toy positioning packaging. The transparent packaging shell has an opening therethrough to allow for access by a user. The toy positioning packaging is positioned within the transparent packaging shell. The toy positioning packaging includes a toy packing portion and an ultraviolet light accessory portion. The toy positioning packaging is formed to hold both the toy and ultraviolet light accessory such that upon activation, ultraviolet light is directed from the ultraviolet light accessory onto a portion of a toy that includes a reveal pigment. Upon exposure to the reveal pigment, the reveal pigment becomes visible to reveal a unique feature of the toy. The toy is, for example, a figurine.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to product packaging and, more particularly, to product packaging that includes a toy and an ultraviolet light accessory positioned within the packaging to illuminate the toy. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
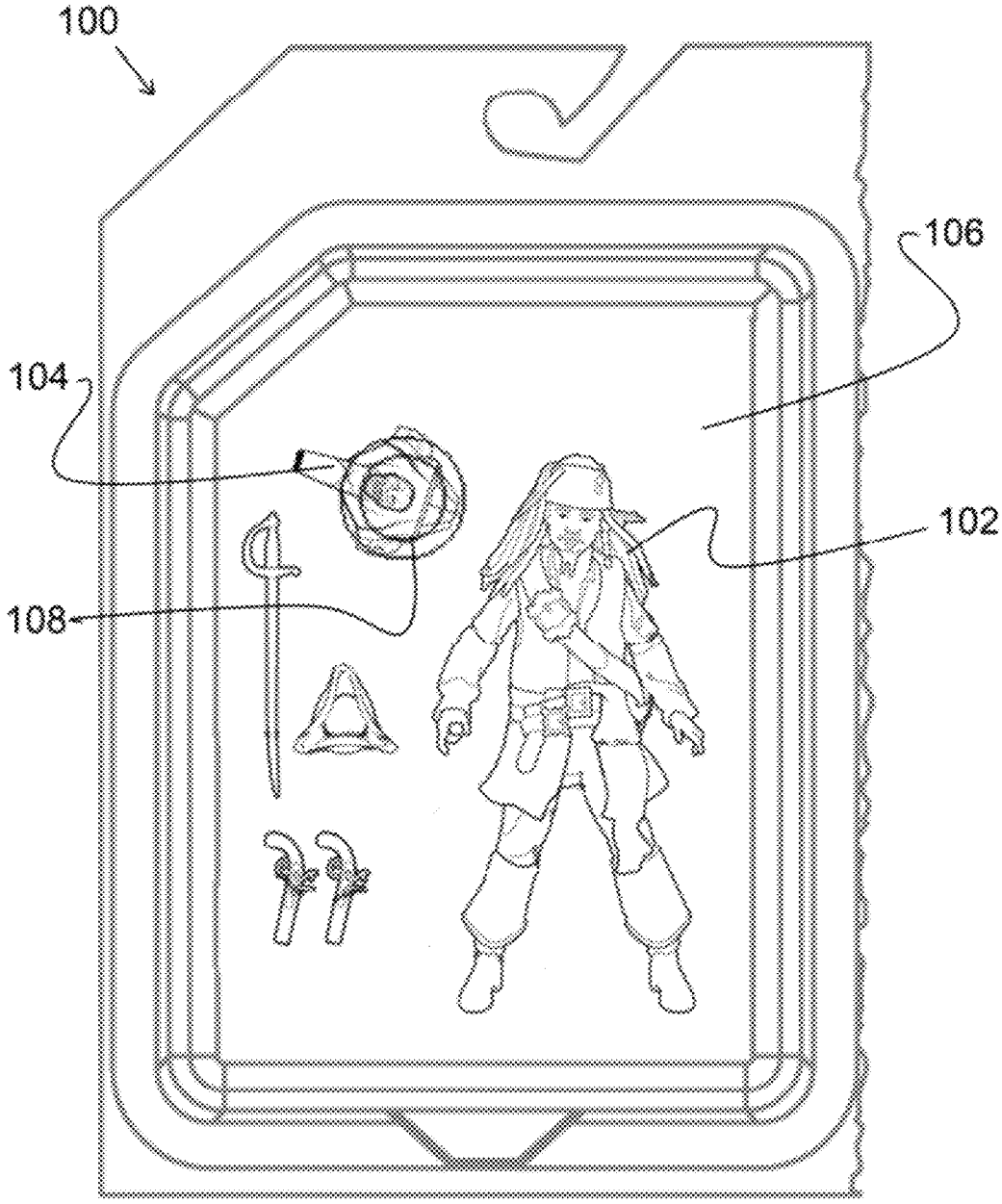
FIG. 1 is a front-view illustration of a packaging item according to the present invention, depicting both a figurine and an ultraviolet light accessory packaged within by the packaging item and held within a transparent packaging shell.

The present invention relates to product packaging and corresponding toys. More specifically and as shown in FIG. 1, the present invention includes product packaging 100 that includes a toy 102 and an ultraviolet light (UV) accessory 104 positioned within the packaging 100. The UV light accessory 104 is held within the packaging 100 in such a way such that it can be activated to emit UV light onto the toy to cause a reveal pigment on the toy to reveal a unique feature of the toy. This aspect will be described in further detail below.

The packaging 100 includes a transparent packaging shell 106 having an opening 108 therethrough. The packaging shell 106 is transparent to allow a potential customer view the toy 102 and light accessory 104 held therein. The packaging shell 106 is formed of any suitable material, a non-limiting example of which includes plastic.

Figure 2:
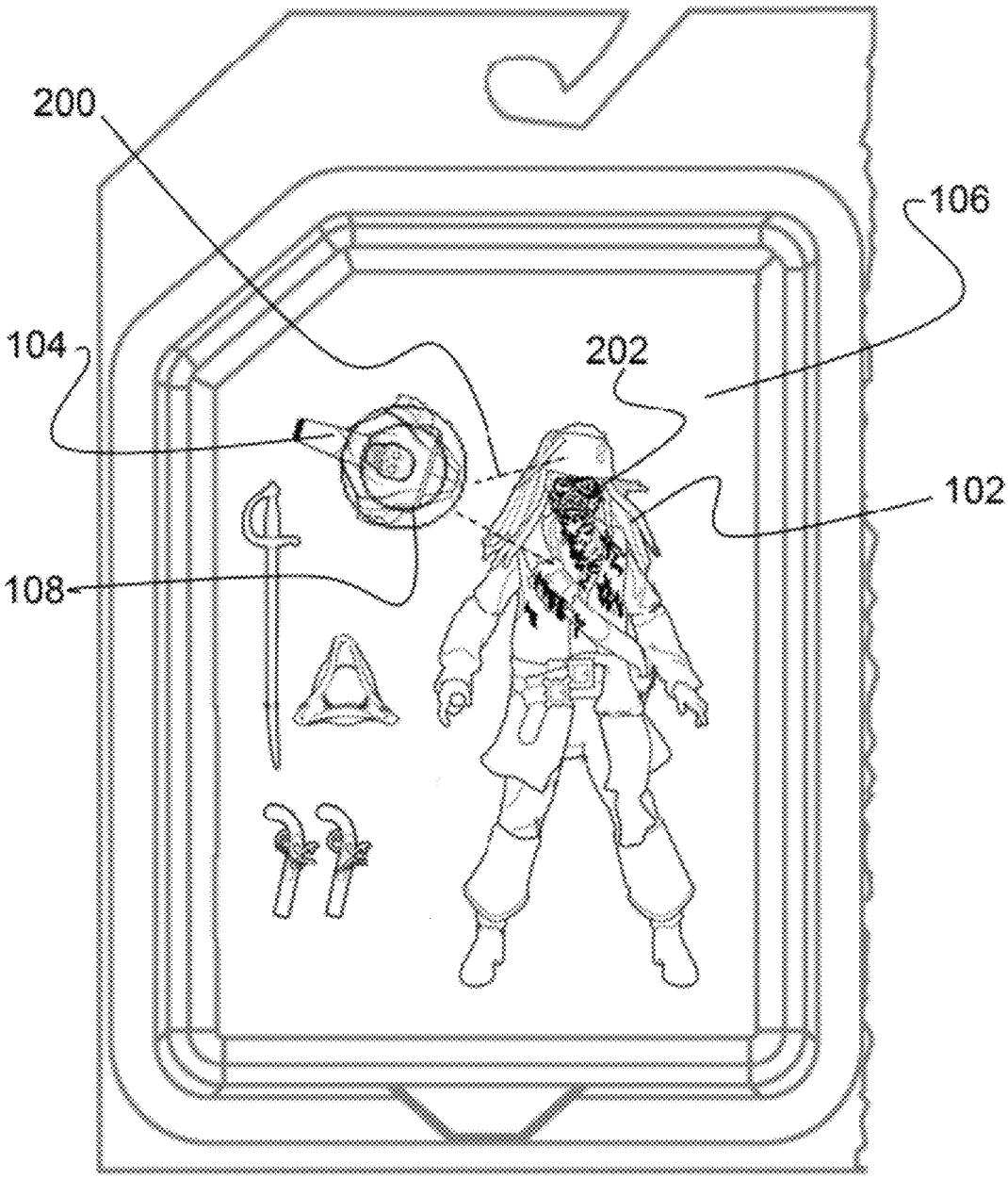
FIG. 2 is a front-view illustration of a packaging item shown in FIG. 1, depicting the ultraviolet light accessory as being activated to emit ultraviolet light onto the figurine to cause a reveal pigment to change from an invisible first state to a visible second state.

As noted above and as further depicted in FIG. 2, the UV light accessory 104 is held within the packaging shell 106 such that the UV light accessory 104 is accessible through the opening 108. Importantly, the UV light accessory 104 is positioned such that when activated, it emits UV light 200 onto the toy 102. The toy 102 includes a reveal pigment 202 applied thereto. The reveal pigment 202 is transparent when in a first state and visible when in a second state. When the reveal pigment 202 is exposed to UV light 200, the reveal pigment 202 becomes visible in the second state. In other words, exposure to UV light 200 causes the reveal pigment 202 to change from the first state (transparent) to the second state (visible). This is shown in FIG. 2 in which the reveal pigment 202 is visible, causing the toy 102 to take on a new appearance (e.g., a decayed character).

The reveal pigment 202 is any suitable pigment that can be applied to or formed within the toy 102. As a non-limiting example, the reveal pigment 202 is an invisible fluorescent ink that immediately ceases fluorescing upon removal from an ultraviolet light and returns to the first state. A non-limiting example of a suitable reveal pigment 202 is the invisible fluorescent ink as made by New Prismatic Enterprises Co., LTD.

Figure 3A:
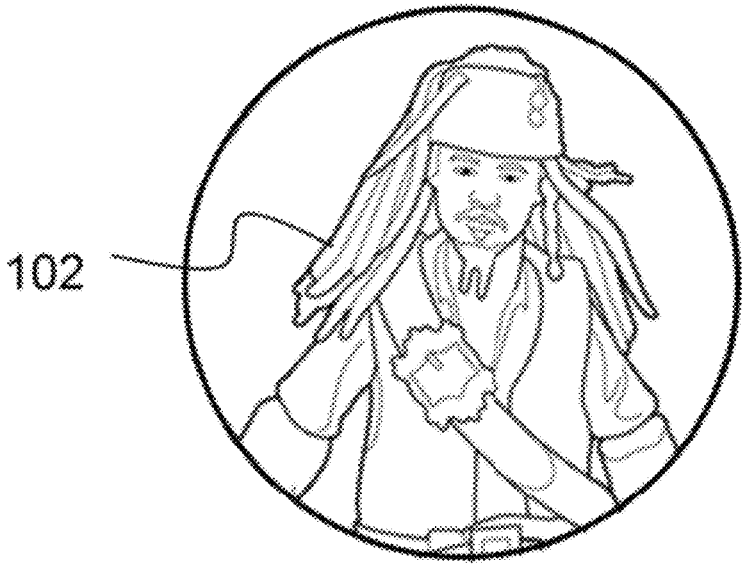
FIG. 3A is a front-view illustration of a figurine with a reveal pigment in a first state.
Figure 3B:
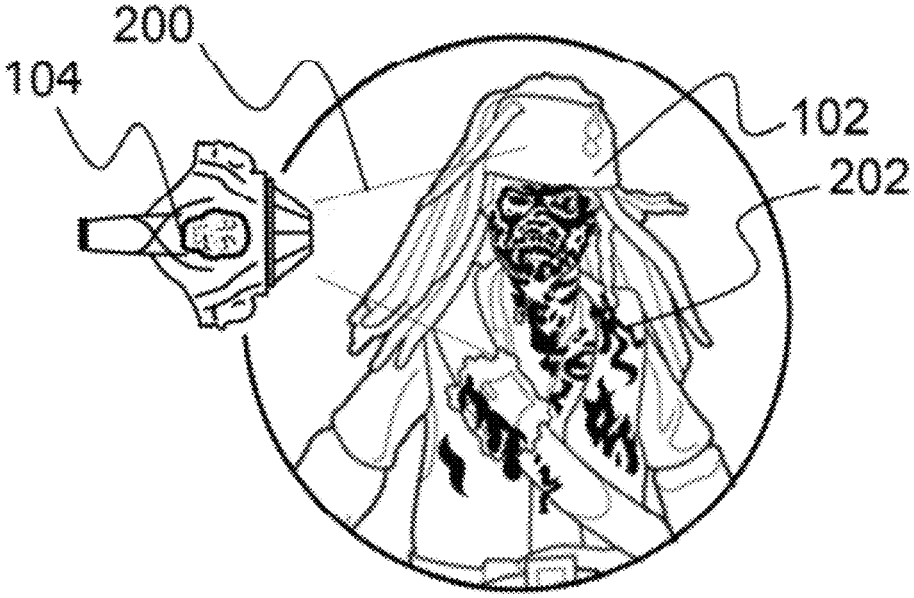
FIG. 3B is a front-view illustration, depicting the reveal pigment as being exposed to ultraviolet light to become visible in the second state.

The reveal effect is further depicted in FIGS. 3A and 3B. As shown in FIG. 3A, the toy 102 includes a reveal pigment that is transparent and not readily visible. However and as shown in FIG. 3B, exposure to UV light 200 from the UV light accessory 104 causes the toy 102 to take on a new appearance as the reveal pigment 202 becomes visible. It should be understood that the toy 102 and UV light accessory 104 can be formed in any suitable embodiment. As a non-limiting example, the toy 102 can be a figurine 100, with the UV light accessory 104 being formed in a coordinating theme. For example, the toy 102 can be formed as a pirate figurine, with the UV light accessory 104 being formed as a pirate-type item, such as a cannon, rum barrel, etc. Other non-limiting examples include the toy 102 being formed as a space alien, with the UV light accessory 104 being formed as a space ship or ray gun.

The UV light accessory 104 includes a UV light (e.g., UV LED) housed therein and a switch for selectively activating the ultraviolet LED. A power source such as a battery is housed within the UV light accessory 104 to power the UV light.

Figure 4:
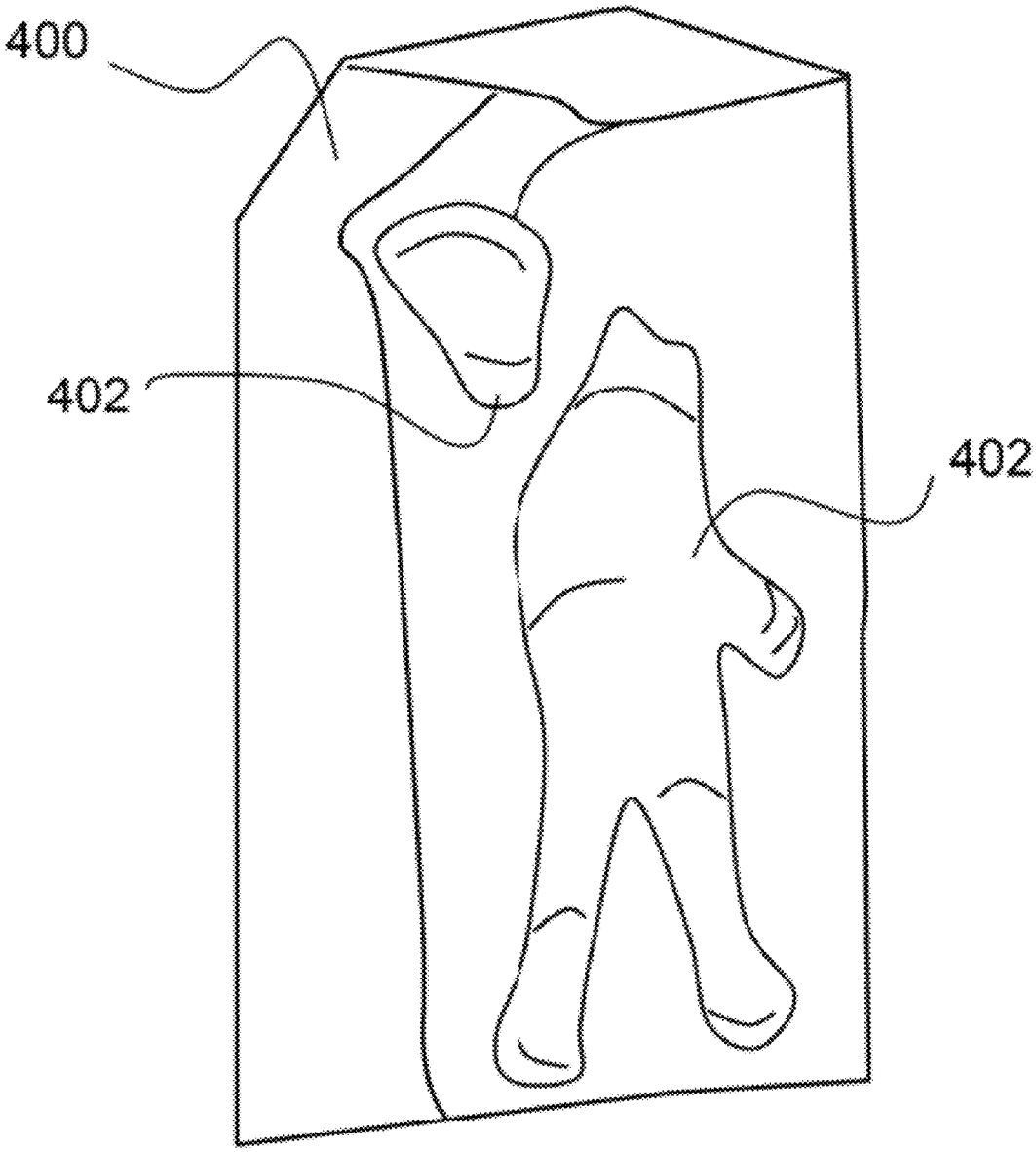
FIG. 4 is a perspective-view illustration of a toy positioning packaging according to the present invention.

To assist in properly positioning the toy and UV light accessory, the packaging includes a toy positioning packaging 400, as shown in FIG. 4. The toy positioning packaging 400 is formed to hold both the UV light accessory and the toy in a desired location. In doing so, the toy positioning packaging 400 includes a toy packing portion 402 and a UV light accessory portion 404. The toy packing portion 402 is formed to hold the toy therein and the UV light accessory portion 404 is formed to hold a UV light accessory. Importantly, both the toy packing portion 402 and UV light accessory portion 404 are formed such the UV light accessory can be accessed and activated by a user through the opening. Further, upon activation, UV light is directed from the UV light accessory onto the reveal pigment of the toy. In other words, the toy positioning packaging 400 holds both the toy and UV light accessory proximate one another such that the UV light accessory is externally accessible and pointed towards the toy. For example, the toy packing portion 402 is formed to matingly engage with a portion of the toy (e.g., figurine). The toy positioning packaging 400 is formed of any suitable material operable for positioning the toy and UV light accessory, a non-limiting example of which includes plastic.

Figure 5:
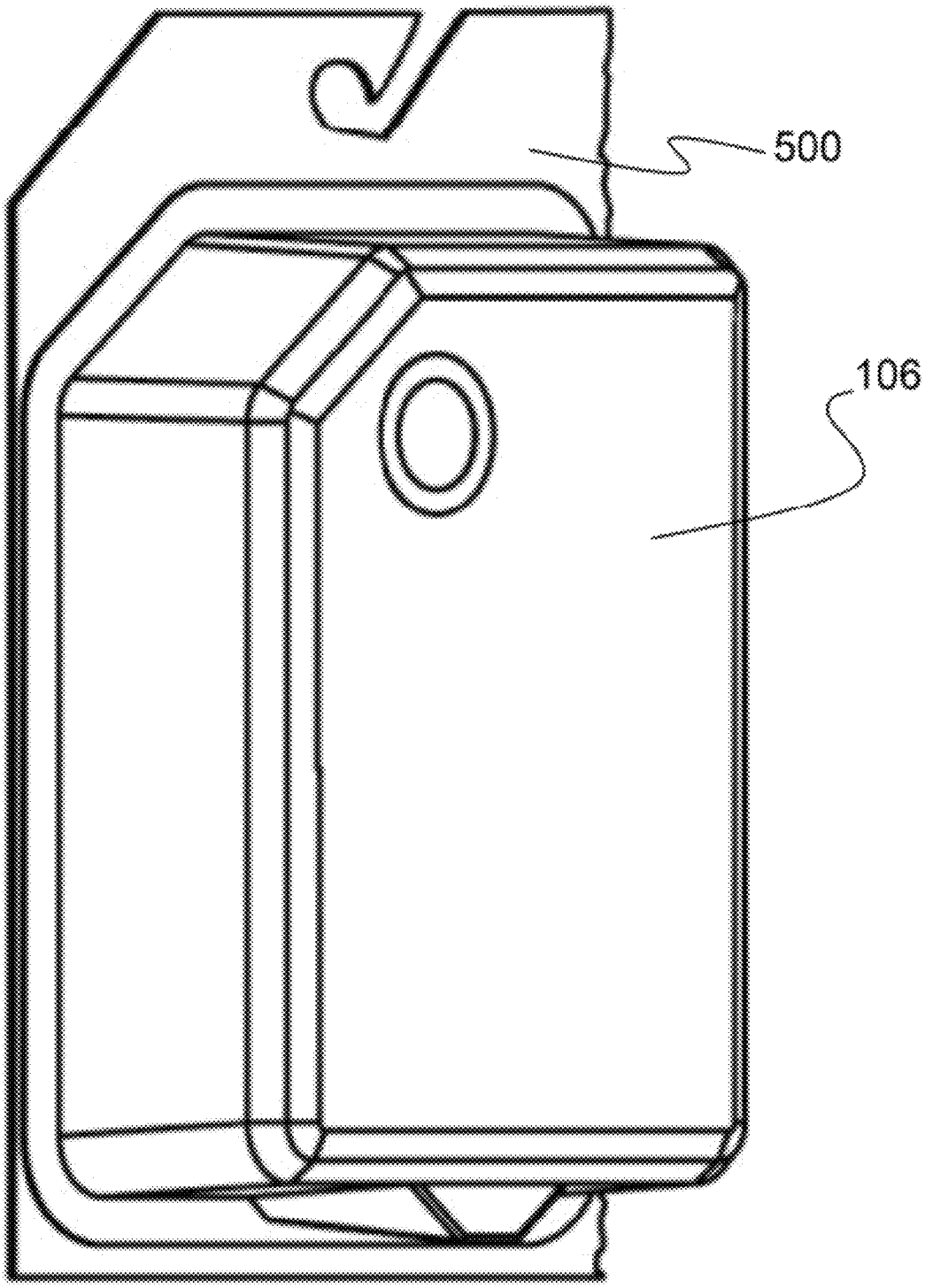
FIG. 5 is perspective-view illustration of a transparent packaging shell according to the present invention.

For further understanding, FIG. 5 depicts the transparent packaging shell 106. The transparent packaging shell 106 can be fully enclosable or, as depicted, affixed with a backing 500 (e.g., cardboard backing) for hanging on a display or shelf.

Figure 6:
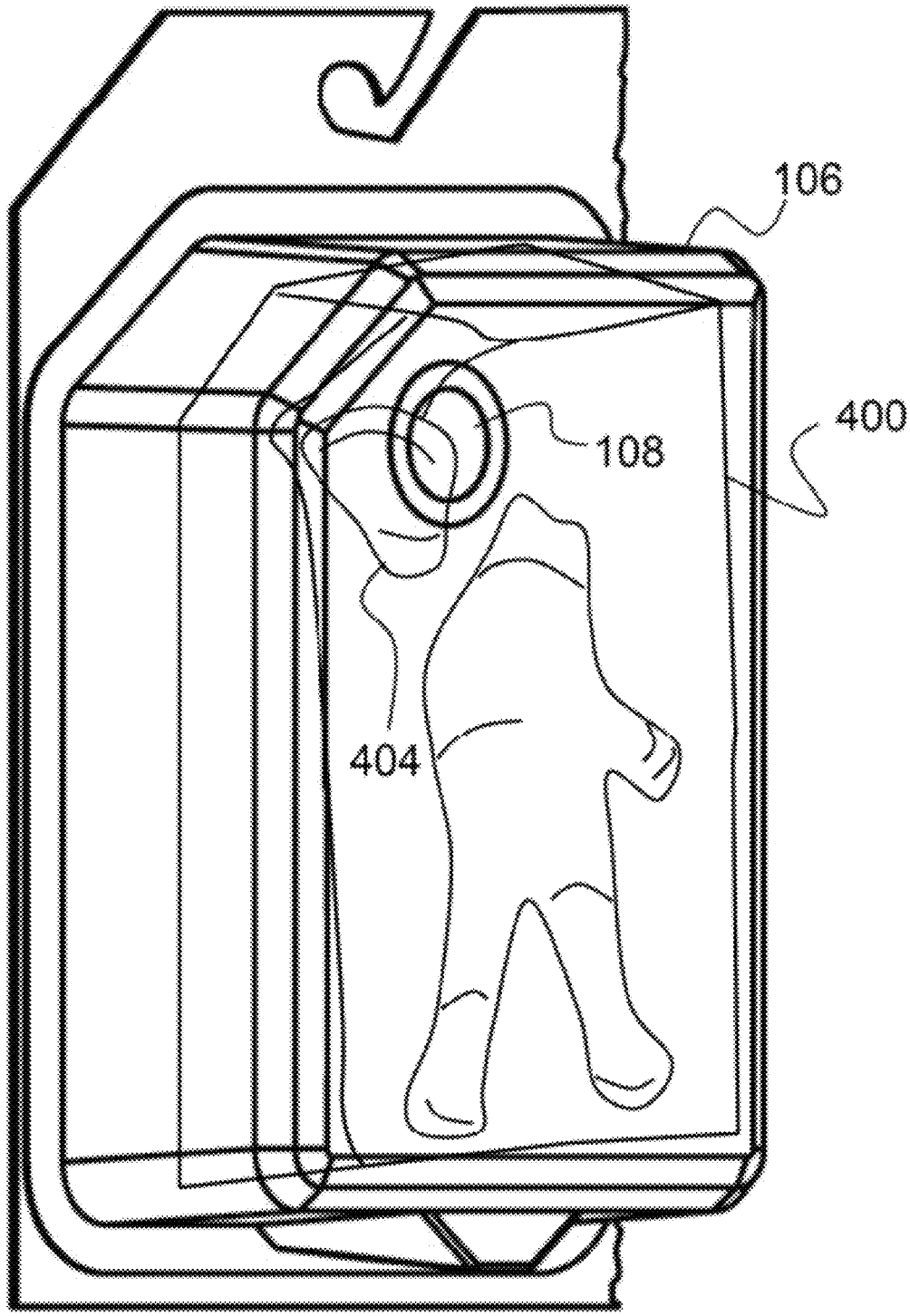
FIG. 6 is a perspective-view illustration, depicting the toy positioning packaging positioned within the transparent packaging shell.
Figure 7:
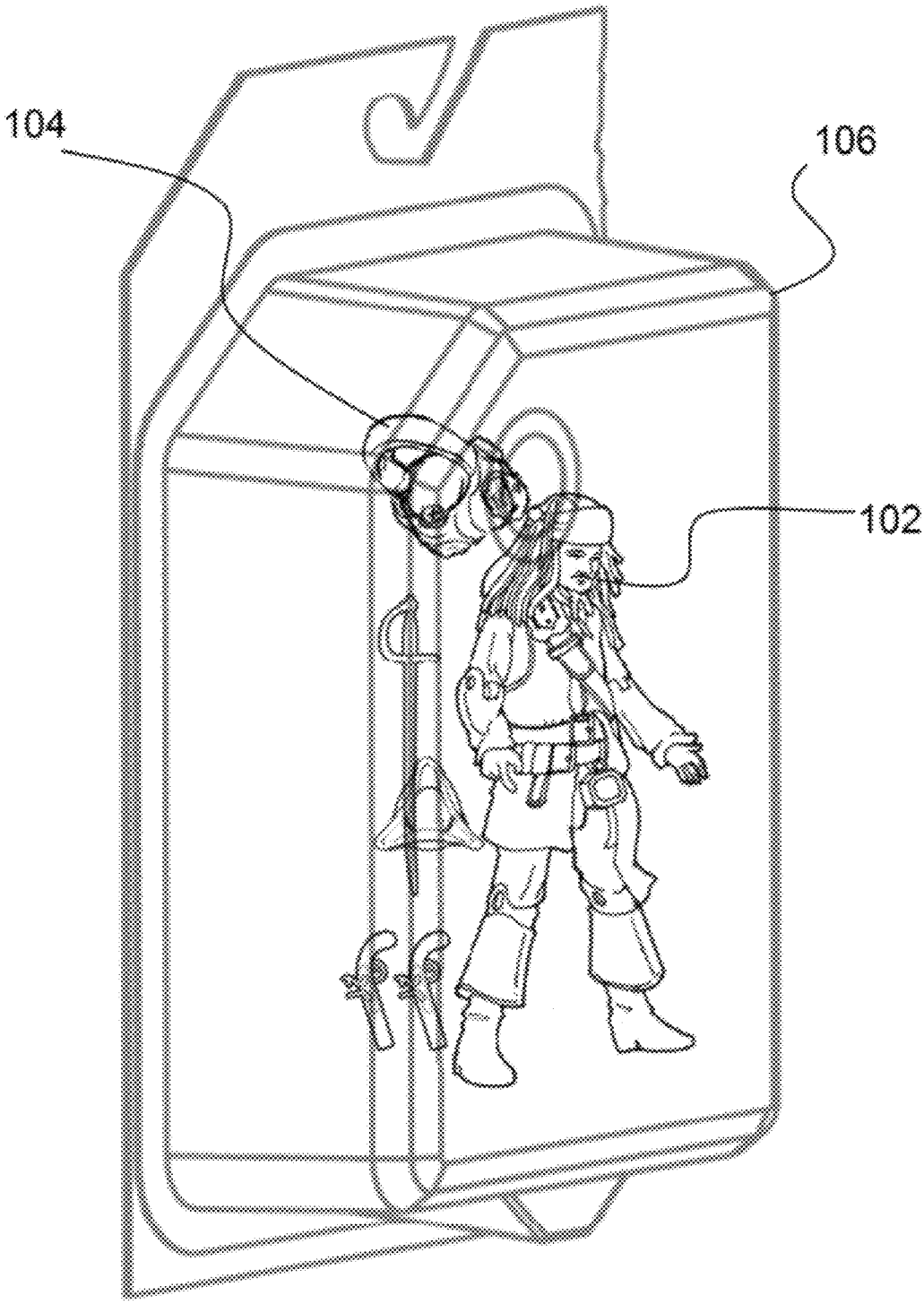
FIG. 7 is a perspective-view illustration, depicting the figurine and ultraviolet light accessory positioned within the transparent packaging shell.
Figures 8, 9:
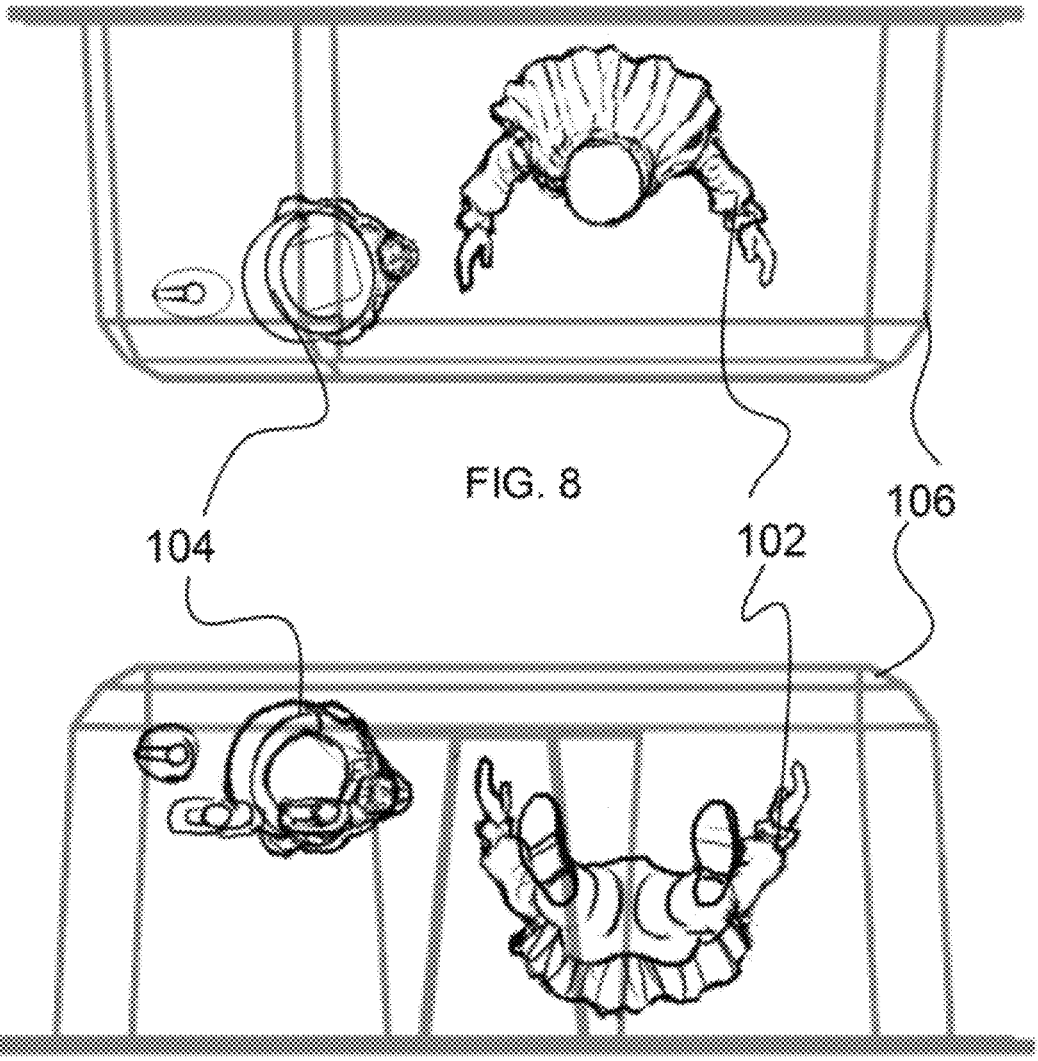
FIG. 8 is a top-view illustration, depicting the figurine and ultraviolet light accessory positioned within the transparent packaging shell.
FIG. 9 is a bottom-view illustration, depicting the figurine and ultraviolet light accessory positioned within the transparent packaging shell.
Figures 10, 11:
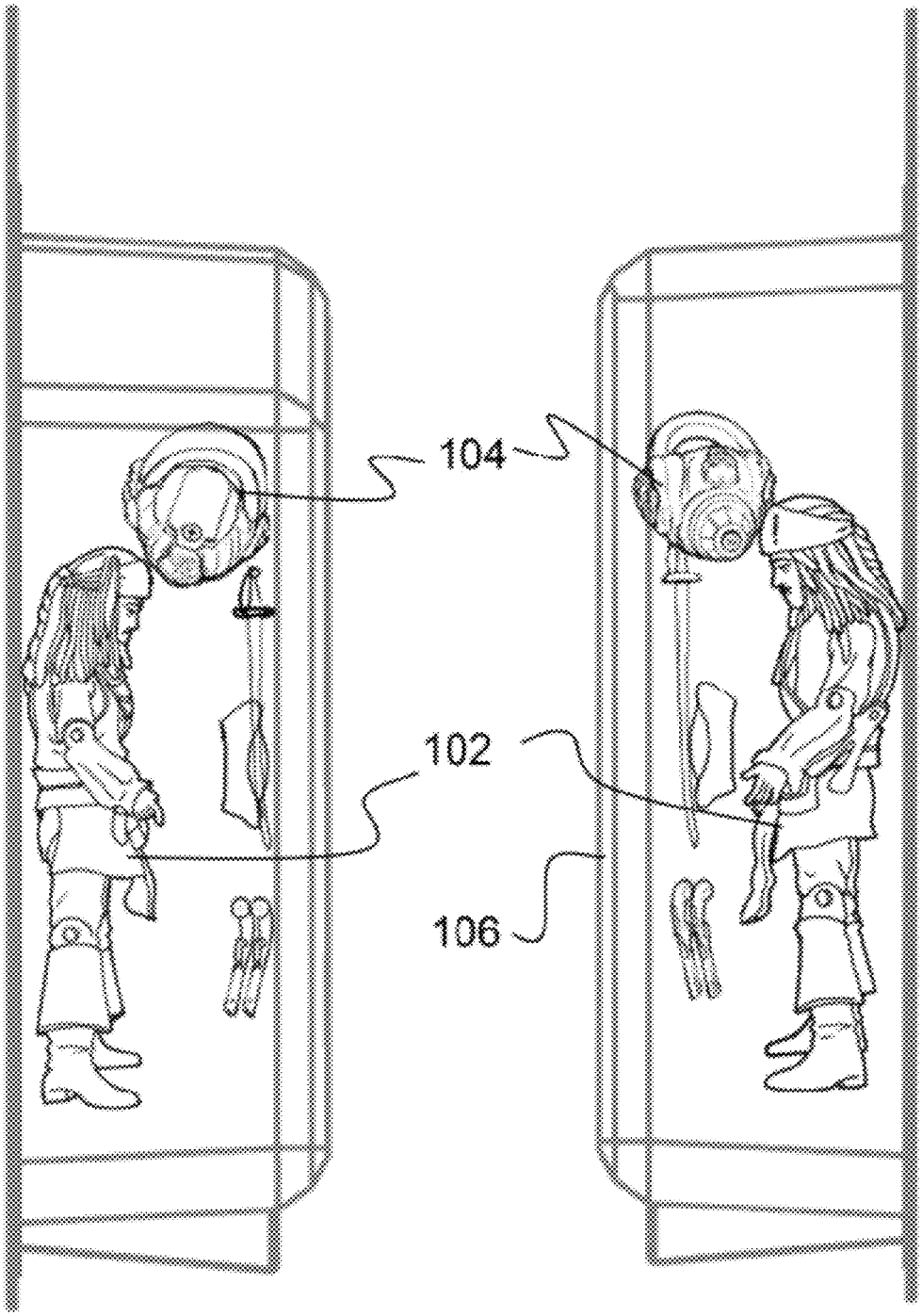
FIG. 10 is a right, side-view illustration, depicting the figurine and ultraviolet light accessory positioned within the transparent packaging shell.
FIG. 11 is a left, side-view illustration, depicting the figurine and ultraviolet light accessory positioned within the transparent packaging shell.

FIG. 6 depicts the toy positioning packaging 400 positioned within the transparent packaging shell 106, showing the relationship between the UV light accessory portion 404 and the opening 108. Thus, the ultraviolet light accessory can be accessed and activated by a user through the opening 108, such that upon activation, ultraviolet light is directed from the ultraviolet light accessory onto the toy.

Finally, FIGS. 7 through 11 depict additional illustrations of the present invention, showing the toy 102 and UV light accessory 104 positioned within the transparent packaging shell 106. It should be understood that although the toy positioning packaging is not illustrated in FIGS. 7 through 11, the item is present as it is transparent and used to properly position the toy 102 and UV light accessory 104 within the transparent packaging shell 106. FIGS. 7 through 11 depict a perspective-view illustration, a top-view illustration, a bottom-view illustration, a right, side-view illustration, and a left, side-view illustration, respectively.

What is claimed is:

1. A packaging item for packaging a toy and an ultraviolet light accessory, comprising:

a transparent packaging shell, the transparent packaging shell forming a cavity and having an opening through the transparent packaging shell for access to the cavity therein;

a toy positioning packaging positioned within the transparent packaging shell, the toy positioning packaging having a toy packing portion and an ultraviolet light accessory portion, the toy packing portion formed to hold a toy that is a separate and distinct item from the transparent packaging shell within the cavity of the transparent packaging shell and the ultraviolet light accessory portion formed to hold an ultraviolet light accessory such the ultraviolet light accessory can be accessed and activated by a user through the opening, such that upon activation, ultraviolet light is directed from the ultraviolet light accessory directly onto the toy that is held within the cavity of the transparent packaging shell;

a toy held by the toy packing portion, the toy having a reveal pigment applied thereto, the reveal pigment being transparent when in a first state and visible when in a second state, such that when the reveal pigment is exposed to ultraviolet light, the reveal pigment becomes visible in the second state; and an ultraviolet light accessory held by the ultraviolet light accessory portion, the ultraviolet light accessory having an ultraviolet LED housed therein and a switch for selectively activating the ultraviolet LED, with the ultraviolet light accessory held by the ultraviolet light accessory portion and positioned within the transparent packaging shell such that light from the ultraviolet LED is directed toward the reveal pigment when the ultraviolet LED is activated.

2. The packaging item as set forth in claim 1, wherein the reveal pigment is an invisible fluorescent ink that immediately ceases fluorescing upon removal from an ultraviolet light and returns to the first state.

3. The packaging item as set forth in claim 2, wherein the toy packing portion is formed to matingly engage with a portion of the toy.

4. The packaging item as set forth in claim 3, wherein the toy packing portion formed is formed to matingly engage with a portion of the toy such that it is formed to mold around the toy.

5. The packaging item as set forth in claim 4, wherein the toy is a figurine, with the toy packing portion formed to mold around the figurine.

* * * * *